US011597216B2

(12) United States Patent
Lien et al.

(10) Patent No.: US 11,597,216 B2
(45) Date of Patent: Mar. 7, 2023

(54) INK JET PRINTER PRODUCTION TECHNIQUES

(71) Applicant: ASSA ABLOY AB, Stockholm (SE)

(72) Inventors: Brent D. Lien, Minneapolis, MN (US); Tanya Jegeris Snyder, Edina, MN (US); Evan Pastor, Edina, MN (US)

(73) Assignee: ASSA ABLOY AB, Stockholm (SE)

( * ) Notice: Subject to any disclaimer, the term of this patent is extended or adjusted under 35 U.S.C. 154(b) by 0 days.

(21) Appl. No.: 17/649,631

(22) Filed: Feb. 1, 2022

(65) Prior Publication Data

US 2022/0184973 A1 Jun. 16, 2022

Related U.S. Application Data

(63) Continuation of application No. 17/060,550, filed on Oct. 1, 2020, now Pat. No. 11,267,258.

(60) Provisional application No. 63/078,266, filed on Sep. 14, 2020.

(51) Int. Cl.
*B41J 11/00* (2006.01)

(52) U.S. Cl.
CPC ..... *B41J 11/002* (2013.01)

(58) Field of Classification Search
CPC ... B41J 11/002; B41J 2/01; B41J 13/12; B41J 11/00214; B41J 11/00212; B41M 7/00; B41M 7/0081
See application file for complete search history.

(56) References Cited

U.S. PATENT DOCUMENTS

| | | | | |
|---|---|---|---|---|
| 6,685,312 | B2 | 2/2004 | Klinefelter et al. | |
| 2003/0184631 | A1 | 10/2003 | Suzuki et al. | |
| 2003/0184632 | A1 | 10/2003 | Suzuki et al. | |
| 2005/0185040 | A1 | 8/2005 | Nagashima | |
| 2007/0013757 | A1 | 1/2007 | Ohnishi | |
| 2012/0176436 | A1* | 7/2012 | Usuda | B41J 11/00214 347/16 |

FOREIGN PATENT DOCUMENTS

| | | | |
|---|---|---|---|
| CN | 1367213 | A | 9/2002 |
| CN | 103747963 | A | 4/2014 |
| EP | 1629979 | A1 | 3/2006 |

(Continued)

OTHER PUBLICATIONS

"U.S. Appl. No. 17/060,550, 312 Amendment filed Jan. 7, 2022", 6 pgs.

(Continued)

*Primary Examiner* — Bradley W Thies
(74) *Attorney, Agent, or Firm* — Schwegman Lundberg & Woessner, P.A.

(57) ABSTRACT

Techniques for operating a printer are provided. In an example, the printer can include a print head a cure light and a controller. The controller can be configured to move the print head relative to a print media to print a given image, to move the cure light relative to the print media at a cure speed in response to the cure light passing over a printed portion of the given image to cure the ink of the given image, and to move the cure light at an index speed in response to the cure light passing over a non-printed portion of the given image, wherein the index speed is greater than the cure speed.

20 Claims, 9 Drawing Sheets

(56) References Cited

FOREIGN PATENT DOCUMENTS

EP 2726297 B1 5/2017

OTHER PUBLICATIONS

"U.S. Appl. No. 17/060,550, Corrected Notice of Allowability dated Jan. 19, 2022", 3 pgs.
"U.S. Appl. No. 17/060,550, Notice of Allowance dated Nov. 1, 2021", 10 pgs.
"U.S. Appl. No. 17/060,550, Response filed Oct. 12, 2021 to Restriction Requirement dated Oct. 8, 2021", 8 pgs.
"U.S. Appl. No. 17/060,550, Restriction Requirement dated Oct. 8, 2021", 7 pgs.
"European Application Serial No. 21181746.5, Extended European Search Report dated Dec. 20, 2021", 13 pgs.
U.S. Appl. No. 17/060,550, filed Oct. 1, 2020, Ink Jet Printer Production Techniques.
"European Application Serial No. 21181746.5, Response Filed Sep. 14, 2022 to Extended European Search Report dated Dec. 20, 2021", 13 pgs.
"Chinese Application Serial No. 202110719661.X, Office Action dated Dec. 23, 2022", w/ English Translation, 17 pgs.

* cited by examiner

INK JET PRINTER PRODUCTION TECHNIQUES

CROSS-REFERENCE TO RELATED APPLICATIONS

This application is a continuation of U.S. patent application Ser. No. 17/060,550, filed Oct. 1, 2020, which claims priority to U. S. Provisional Application Ser. No. 63/078,266, filed Sep. 14, 2020, each of which is herein incorporated by reference in its entirety.

FIELD OF THE DISCLOSURE

The present document relates to printing, and more particularly, to techniques for improving production of an ink jet printer.

BACKGROUND OF THE DISCLOSURE

Card products include, for example, credit cards, identification cards, driver's licenses, passports, and other card products. Such card products generally include printed information, such as a photo, account numbers, identification numbers, and other personal information. Credentials can also include data that is encoded in a smartcard chip, a magnetic stripe, or a barcode, for example.

Card production systems include processing devices that process card substrates (hereinafter "cards") to form the final card product. Such processes may include a printing process, a laminating or transfer process, a data reading process, a data writing process, laser engraving, and/or other process used to form the desired credential. An ink jet card printer is a form of card production system that utilizes an ink jet print head to print images to cards.

In certain applications, printed ink cures after printing. Curing makes the print bond to the substrate or card better and reduces the chances that the print will smear.

Curing can be accelerated by subjecting the ink to a cure light. Conventional methods of using a cure light scan the cure light across the entire substrate before allowing the substrate to be removed from the print area and substantially effect printer throughput.

SUMMARY OF THE DISCLOSURE

Techniques for operating a printer are provided. In an example, the printer can include a print head, a cure light, and a controller. The controller can be configured to move the print head relative to a print area to print a given image, to move the cure light relative to the print area at a cure speed in response to the cure light passing over a printed portion of the given image to cure the ink of the given image, and to move the cure light at an index speed in response to the cure light passing over a non-printed portion of the given image, wherein the index speed is greater than the cure speed.

DETAILED DESCRIPTION

Embodiments of the present disclosure are generally directed to ink curing of an ink jet card printer. In general, the techniques modulate the relative speed of a curing light source across a newly printed card such that a faster relative speed is used across areas of the card that do not have a portion of the image printed thereon. The techniques can reduce the processing time of a card compared to conventional techniques that move the curing light source across the entire card at a slow cure speed regardless of whether the image occupies the entire path across the card.

Figure 1:
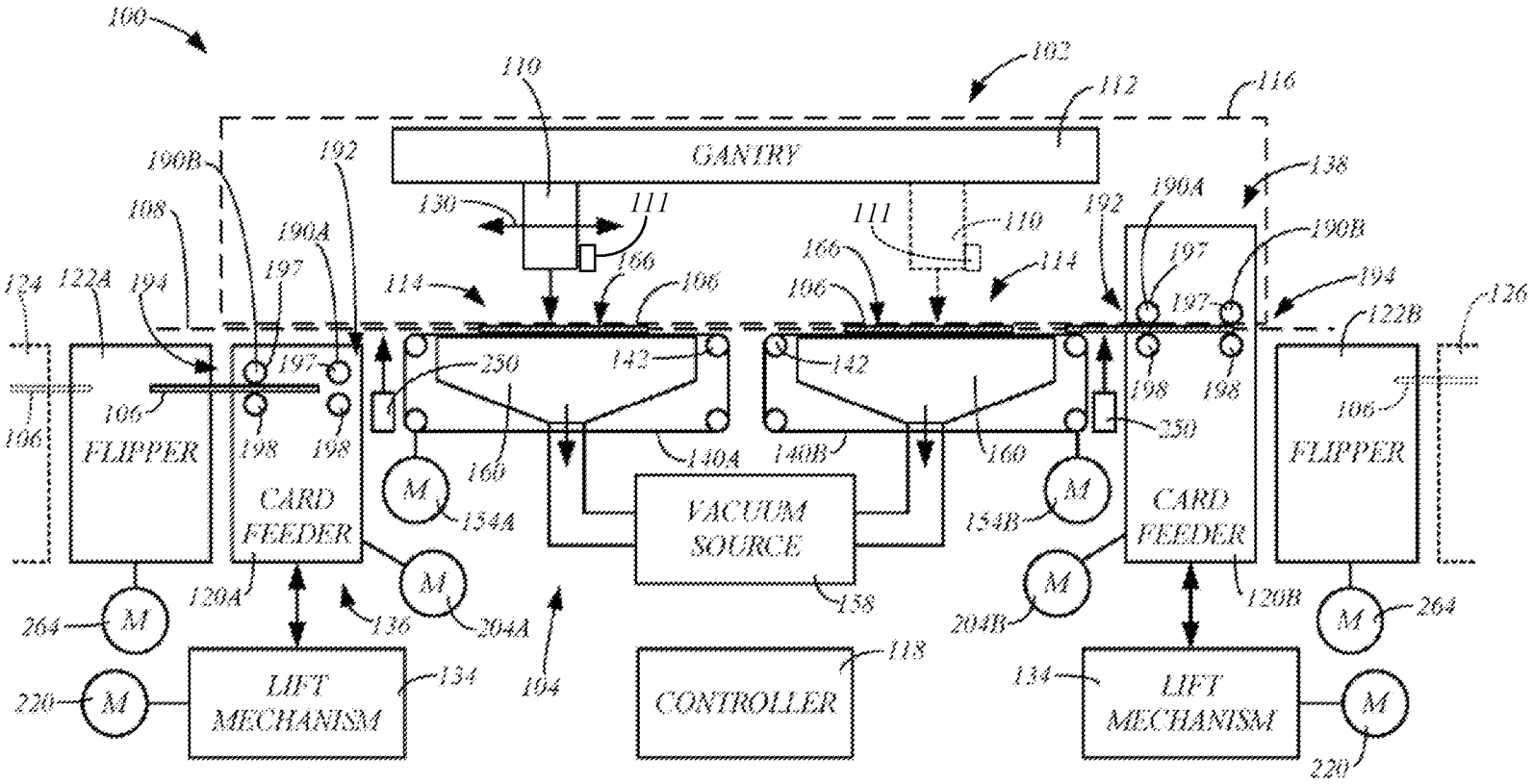
FIG. 1 illustrates generally a block diagram side view of an example ink jet card printer according to the present subject matter.
Figure 2:
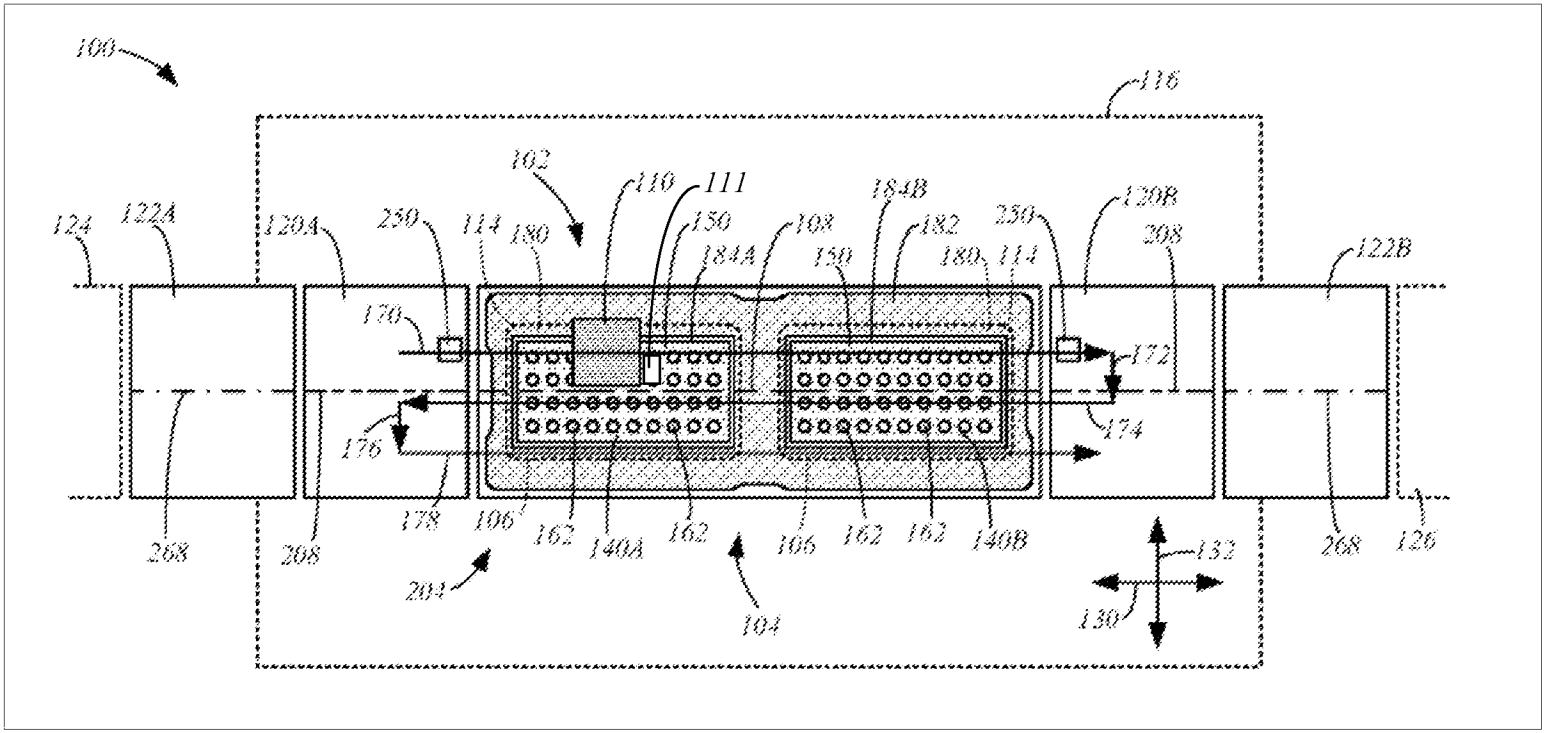
FIG. 2 illustrates generally a top view of an example ink jet card printer according to the present subject matter.

FIGS. 1 and 2 are simplified side and top views of an ink jet card printer 100, or portion thereof, in accordance with embodiments of the present disclosure. In some embodiments, the ink jet card printer 100 includes a print unit 102, and a card transport 104. The card transport 104 is configured to feed individual cards 106 along a processing axis 108. The print unit 102 includes an ink jet print head 110 and a gantry 112. The print head 110 is configured to perform a printing operation on individual cards 106 supported by the card transport 104 in one or more print positions 114 along the processing axis 108. The gantry 112 is configured to move the print head 110 through a print zone 116 during printing operations.

In some embodiments, the ink jet card printer 100 includes a controller 118, which represents one or more distinct controllers of the ink jet card printer 100, each of which includes at least one processor that is configured to execute program instructions stored in a computer-readable media or memory of the ink jet card printer 100, which may also be represented by the controller 118, or another location. Any suitable patent subject matter eligible computer readable media or memory may be utilized including, for example, hard disks, CD-ROMS, optical storage devices, flash memory, magnetic storage devices, or other suitable computer readable media or memory that do not include transitory waves or signals. The execution of the instructions by the controller 118 controls components of the ink jet card printer 100 to perform functions and method steps described herein.

In certain examples, the ink jet card printer 100 may include one or more card feeders 120, such as card feeders 120A and 120B, that are each configured to deliver cards 106 to, and receive cards 106 from, the card transport 104. The ink jet card printer 100 may also include one or more card flippers 122, such as flippers 122A and 122B, that are configured to invert the cards 106. A card supply 124, such as a card cartridge containing a stack of cards, may be provided to supply cards 106 for processing by the ink jet card printer 100, and processed cards may be discharged and collected by a suitable card collector (e.g., a hopper) 126.

The ink jet print head 110 is configured to perform a direct printing operation to individual cards 106 supported in the print positions 114 along the processing axis 108. The gantry 112 can move the print head 110 along a first scan axis 130 that is substantially parallel to the processing axis 108, and a second scan axis 132 that is substantially perpendicular to the processing axis 108, as shown in FIG. 2, during printing operations. As used herein, the term "first scan axis" refers to the axis along which the print head 110 is moved by the gantry 112 during an active printing phase of the operation, during which ink is discharged from the print head 110 to form the image on the card 106. The term "second scan axis" refers to the axis along which the print head 110 can be moved by the gantry 112 during an inactive printing phase (ink is not discharged from the print head) to position the print head 110 for the next active printing phase.

In some embodiments, the gantry 112 and the print head 110 may occupy the print zone 116 during printing operations, which is indicated by dashed boxes in FIGS. 1 and 2. The print zone 116 may generally extend from the processing axis 108, or immediately above the processing axis 108, into at least a portion of the space above the card transport 104 and the card feeders 120. The print zone 116 may also surround the card transport 104 and the card feeders 120, as shown in FIG. 2.

Figure 3:
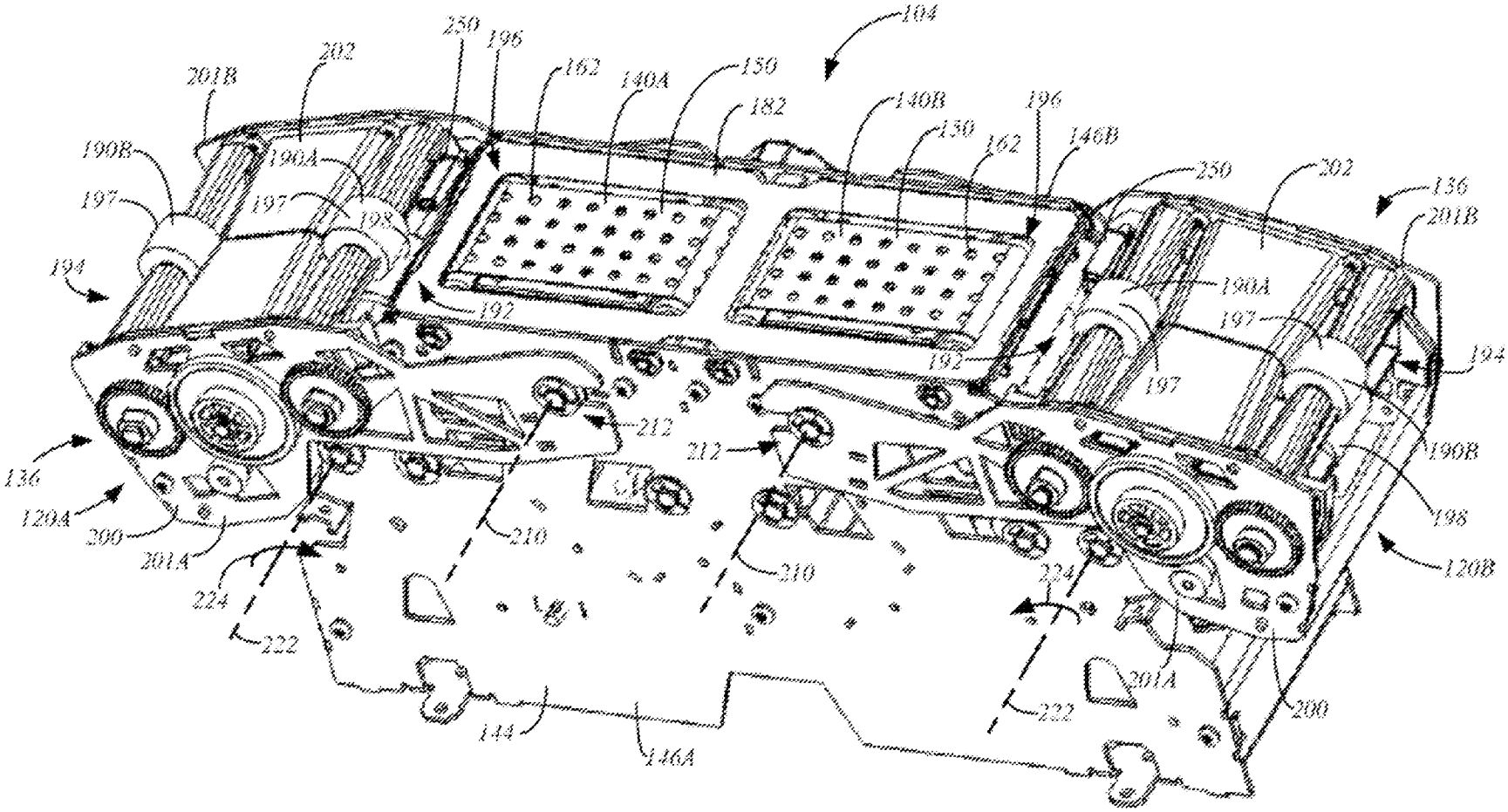
FIG. 3 illustrates generally a perspective view of a card transport of an example ink jet card printer according to the present subject matter.

In some embodiments, the card feeders 120 each include a lift mechanism 134 to move the card feeders 120 to a lowered position, in which the card feeders 120 are displaced from the print zone 116, such as below the print zone 116, as indicated by card feeder 120A in FIG. 1, and the card feeders 120A and 120B in FIG. 3. FIG. 3 is an isometric view of a card transport 104 and card feeders 120 in their lowered positions 136.

The lift mechanisms 134 may also move the card feeders 120 to a raised position, in which at least a portion of the card feeders 120 extend into the print zone 116, and the card feeders 120 are positioned to feed cards 106 to, or receive cards 106 from, the card transport 104, as indicated by the card feeder 120B in FIG. 1. Thus, the card feeders 120 may be moved to their raised positions by the lift mechanisms 134 to facilitate feeding cards 106 to or receiving cards 106 from the card transport 104.

Thus, the lift mechanisms 134 may be used to move the card feeders 120 from their raised positions, in which at least a portion of the card feeders 120 would obstruct a printing operation, to their lowered positions, in which the card feeders 120 do not obstruct the print zone 116, to enable the print head 110 to be moved through the print zone 116 by the gantry 112 and perform a printing operation.

In some embodiments, the card transport 104 includes belts 140, such as first and second belts 140A and 140B (i.e., belt feeders or conveyors), that are each supported by rollers 142 for movement along a belt path. In one example, the first and second belts 140A and 140B are each supported by four rollers 142, which are supported by a belt frame 144, such as side walls 146A and 146B of the belt frame 144 (FIG. 3). The belts 140 include exposed portions 150 adjacent the processing axis 108. The exposed portion 150 of each of the belts 140 is used to feed the cards 106 along the processing axis 108 and support the cards 106 in the print positions 114.

Motors 154A and 154B can independently drive the first and second belts 140A and 140B along their belt paths. Thus, the exposed portion 150 of the first belt 140A may independently feed a card 106 along the processing axis 108 in a direction toward the second belt 140B or in a direction toward the card feeder 120A using the motor 154A, and the exposed portion 150 of the second belt 140B may independently feed a card 106 along the processing axis 108 in the direction toward the first belt 140A, or in the direction toward the card feeder 120B using the motor 154B.

The belts 140 of the card transport 104 may take on any suitable form. In some embodiments, the belts 140 are conventional vacuum belts that are coupled to a vacuum source 158 (i.e., a source of negative pressure), such as a regenerative vacuum blower. The vacuum source 158 may be shared by the belts 140, as shown in FIG. 1, or separate vacuum sources 158A and 158B may respectively be used by the belts 140A and 140B. Chambers 160 couple the negative pressure generated by the vacuum source 158 to the exposed portions 150 of the belts 140. The negative pressure is communicated to a top side of the exposed portions 150 through apertures 162 in the belts, which are shown in FIGS. 2 and 3, and is used to secure cards 106 to the exposed portions 150 during card feeding and printing operations.

Thus, when a card 106 engages the top surface of the exposed portion 150 of one of the belts 140, the negative pressure generated by the vacuum source 158 or sources 158A and 158B adheres the card 106 to the belt 140. When the belts 140 are driven by the corresponding motor 154, the adhered card 106 is driven along the processing axis 108.

For example, referring to FIG. 2, with the card feeders 120 in their lowered positions, and the cards 106 held in the print positions 114 against the exposed portions 150 of the belts 140A and 140B due to the negative pressure generated by the vacuum source 158 or sources 158A and 158B, the gantry 112 may move the print head 110 along the first scan axis 130 (processing axis 108) over the cards 106, while the print head 110 prints image lines to the surfaces 166, as indicted by arrow 170. After the print head 110 is moved past the end of the card 106 adjacent the card feeder 120B, the gantry 112 shifts the print head 110 along the second scan axis 132, as indicated by arrow 172. The gantry 112 then moves the print head 110 back along the first scan axis 130 (arrow 174), during which the print head 110 prints image lines to the surfaces 166 of the cards 106. The gantry 112 again shifts the position of the print head 110 along the second scan axis 132 (arrow 176), and the print head 110 prints image lines as the gantry 112 moves the print head 110 along the first scan axis 130 (arrow 178). These steps of printing image lines while moving the print head 110 along the first scan axis 130 and shifting the position of the print head 110 along the second scan axis 132, are repeated until the images have been printed to the surfaces 166 of the cards 106. Accordingly, a single print operation may simultaneously print images to two cards 106 supported on the belts 140.

To print a full edge-to-edge image on a card 106, the print head 110 may be configured to print an image that is slightly larger than the surface 166 of the card 106. As a result, some ink will overspray the edges of the card 106.

In some embodiments, the exposed surface 150 of each belt 140 has a smaller surface area than the card 106. That is, the width and length of the exposed belt surfaces 150 are selected such that they are less than the corresponding width and length of the cards 106, as generally shown in FIG. 2 with the cards 106 shown in phantom lines. Thus, when a card 106 is in the print position 114, the entirety of the exposed belt surface 150 is covered by the card 106, and a perimeter portion 180 of the card 160 extends beyond the edges of the exposed belt surface 150. This allows the print head 110 to print images that extend to the edges of the surfaces 166 of cards 106 while protecting the exposed belt surface 150 from ink contamination.

In some embodiments, the ink jet card printer 100 includes an ink overspray collector 182 that surrounds a perimeter of the exposed belt surface 150 and extends beyond the edges of the cards 106 when in their print positions 114, as shown in FIG. 2. Thus, the collector 182 is positioned to receive ink that is sprayed over the lengthwise and widthwise edges of the cards 106 during a printing operation. In some embodiments, the ink overspray collector 182 is a disposable component that may be periodically removed and replaced by an operator of the ink jet card printer 100. The collector 182 may be formed of plastic, paper, cardboard, or another suitable material. In some embodiments, the collector 182 is a single piece of material having an opening 184A for the exposed belt surface 150 of the belt 140A, and an opening 184B for the exposed belt surface 150 of the belt 140B.

In some embodiments, the card feeders 120 each include at least one pinch roller pair 190, such as pinch roller pairs 190A and 190B. In some embodiments, at least a portion of one or both of the pinch roller pairs 200 extends into the print zone 116 when the card feeder 120 is in a raised position. The pinch roller pairs 190A and 190B are respectively positioned adjacent ports 192 and 194 of the card feeder 120, with the port 192 being positioned adjacent an input/output end 196 of the corresponding belt 140, as shown in FIG. 3. Each pinch roller pair 190 may include an idler roller 197 and a motorized feed roller 198 that are supported by a card feeder frame 200, such as between side walls 201A and 201B of the frame 200, as shown in FIG. 3. While the idler roller 197 is illustrated as being the top roller in the provided examples, it is understood that the positions of the rollers 197 and 198 may be reversed. A cover 202 may be positioned between the pinch roller pairs 190A and 190B to cover a portion of the path through which cards 106 are fed through the card feeder 120, as shown in FIG. 3.

The card feeders 120A and 120B respectively include motors 204A and 204B for driving the motorized rollers 198 to feed a card 106 supported between one or both of the pinch roller pairs 190A and 190B along a card feed axis 208. The separate motors 204 of the feeders 120 allow the controller 118 to independently control the card feeders 120. As a result, the card feeder 120A may be used to deliver a card 106 to the belt 140A while the card feeder 120B delivers a card 106 to the collector 126, for example.

The card feed axis 208 of each feeder 120 is substantially parallel to a vertical plane extending through the processing axis 108. Thus, as shown in the top view of FIG. 2, the card feed axes 208 of the feeders 120 are oriented substantially parallel (e.g., +–0.5 degrees) to the processing axis 108 within a horizontal plane.

In some embodiments, the lift mechanisms 134 pivot the frame 200 of the card feeders 120 about a pivot axis 210 (FIG. 3) during movement of the card feeders 120 between their raised and lowered positions. As a result, the orientation of the card feed axis 208 relative to the processing axis 108 in a vertical plane changes with movement of the card feeders 120 between their raised and lowered positions 138 and 136. When the card feeder 120 is in its lowered position, the card feed axis 208 is at an oblique angle (e.g., 20-50 degrees) to the processing axis 108 in the vertical plane. When the card feeder 120 is in its raised position, the card feed axis 208 is substantially parallel to the processing axis 108 in the vertical plane, allowing the card feeder 120 to deliver a card 106 to the adjacent belt 140, or receive a card 106 from the adjacent belt 140 using one or more of the pinch roller pairs 190.

In some embodiments, the pivot axis 210 is defined by a pivotable connection 212 between the card feeder frame 200 and the belt frame 144, as indicated in FIG. 3. In one embodiment, the pivotable connection or hinge 212 is formed between the side walls 201A and 201B of the card feeder frame 200 and the corresponding side walls 146A and 146B of the belt frame 144.

During an exemplary lift operation, in which the card feeder 120 is moved from the lowered position to the raised position, the controller 118 activates the motor 220 of the lift mechanism 134 to drive rotation of a cam (not shown) about the axis 222 in the direction indicated by arrow 224 in FIG. 3. As the cam rotates, it drives the card feeder frame 120 to pivot about the pivot axis 210 until the card feeder 120 reaches the raised position. The operation is reversed to move the card feeder 120 back to its lowered position.

Ideally, each card feeder 120 supports a received card 106 such that a central axis of the card 106 is aligned with the card feed axis 208. This ensures that the card 106 is fed to the adjacent belt 140 in alignment with the processing axis 108, which allows for accurate positioning of the card 106 in the print position 114 on the belt 140 and accurate printing of an image to the card surface 166.

The printer 100 may include one or more sensors 250 to facilitate various card feeding operations, such as receiving a card 106 in the card feeders 120 and positioning a card 106 in the print position 114 on the belts 140. In one embodiment, the printer 100 includes a card sensor 250 for detecting the presence or absence of a card at each side of the card transport 104. In some embodiments, the card sensors 250 are positioned between the pinch roller pair 190A and the adjacent belt 140. In some embodiments, the card sensors 250 are supported by the card feeder frame 200.

During reception of a card 106 by a card feeder 120 in its lowered position, the sensor 250 may be used to detect the leading edge of the card 106 being fed toward the card transport belt 140, which may indicate that the card 106 is fully received in the card feeder 120. The card feeder 120 may then be moved from the lowered position to the raised position. After the card feeder 120 is moved to the raised position, the corresponding card sensor 250 may be used to detect the trailing edge of the card 106 as the card is fed to the adjacent belt 140. The controller 118 may use this detection of the trailing edge of the card 106 to control the belt 140 to position the card 106 in the desired print position 114.

The card sensors 250 may also be used by the controller 118 to control the reception of cards 106 fed from the belts 140 by the card feeders 120. For example, as a card 106 is fed from the belt 140 toward the card feeder 120, the card sensor 250 may detect the leading edge of the card 106. This detection may be used by the controller 118 to control the pinch roller pairs 190 to receive the card 106 in the card feeder 120. The card 106 may then be fed into the card feeder 120 using the pinch roller pairs 190 until the sensor 250 detects the trailing edge of the card 106 indicating that the card 106 has been fully received within the card feeder 120 and that the card feeder 120 is ready to be moved to its lowered position 136.

As mentioned above, the printer may optionally include one or more card flippers 122 driven by one or more motors 264 that may be used to invert cards 106 to facilitate printing operations on both sides of the cards 106. Each card flipper 122 may be configured to receive a card 106 from the adjacent card feeder 120, the card supply (flipper 122A) or the card collector (flipper 122B), rotate the card 106 about a flipping axis 260 to invert the card 106, and pass the inverted card 106 back to the adjacent card feeder 120, which can deliver the inverted card 106 to the card transport 104 and the print unit 102 for a printing operation.

Some embodiments of the present disclosure are directed to methods of printing an image to one or more cards 106 using the ink jet card printer 100. In one embodiment of the method, a card 106, which may have been received from the supply 124 and fed to the card feeder 120A by the card flipper 122A, is supported by the pinch roller pairs 190 of the card feeder 120A while in its lowered position.

The card feeder 120A is moved to its raised position using the corresponding lift mechanism 134, and the card 106 is discharged from the card feeder 120A to the belt 140A using the pinch roller pair 190A. The card feeder 120A is then moved to the lowered position and out of the print zone 116 using the lift mechanism 134, and the card 106 is fed along the processing axis 108 by the belt 140A to the print position 114 (FIG. 2). An image is then printed to the surface 166 of the card 106 using the print head 110, which involves moving the print head 110 with the gantry 112 through the print zone 116.

In certain examples, the ink jet card printer 100 can include a cure light 111 to assist in hardening recently ejected ink. Such a cure light 111 can project ultraviolet (UV) light for curing UV-curable inks. In some examples, the cure light 111 can be attached to the ink jet print head 110 and can move with the ink jet print head 110.

In some examples, the cure light 111 is attached to an axis separate from the ink jet print head axis and can move independent of the ink jet print head 110. In operation, after an image is printed, conventional systems pass an illuminated cure light across the entire width or length of the printed media to cure, or harden, the printed ink. For an ink jet printer according to the present subject matter, after printing of an image onto print media using curable ink, the cure light 111 can be passed over the image at a cure speed and can be moved over unprinted portions of the print media, or retracted over cured portions of the image, at a speed higher than the cure speed.

Figure 4:
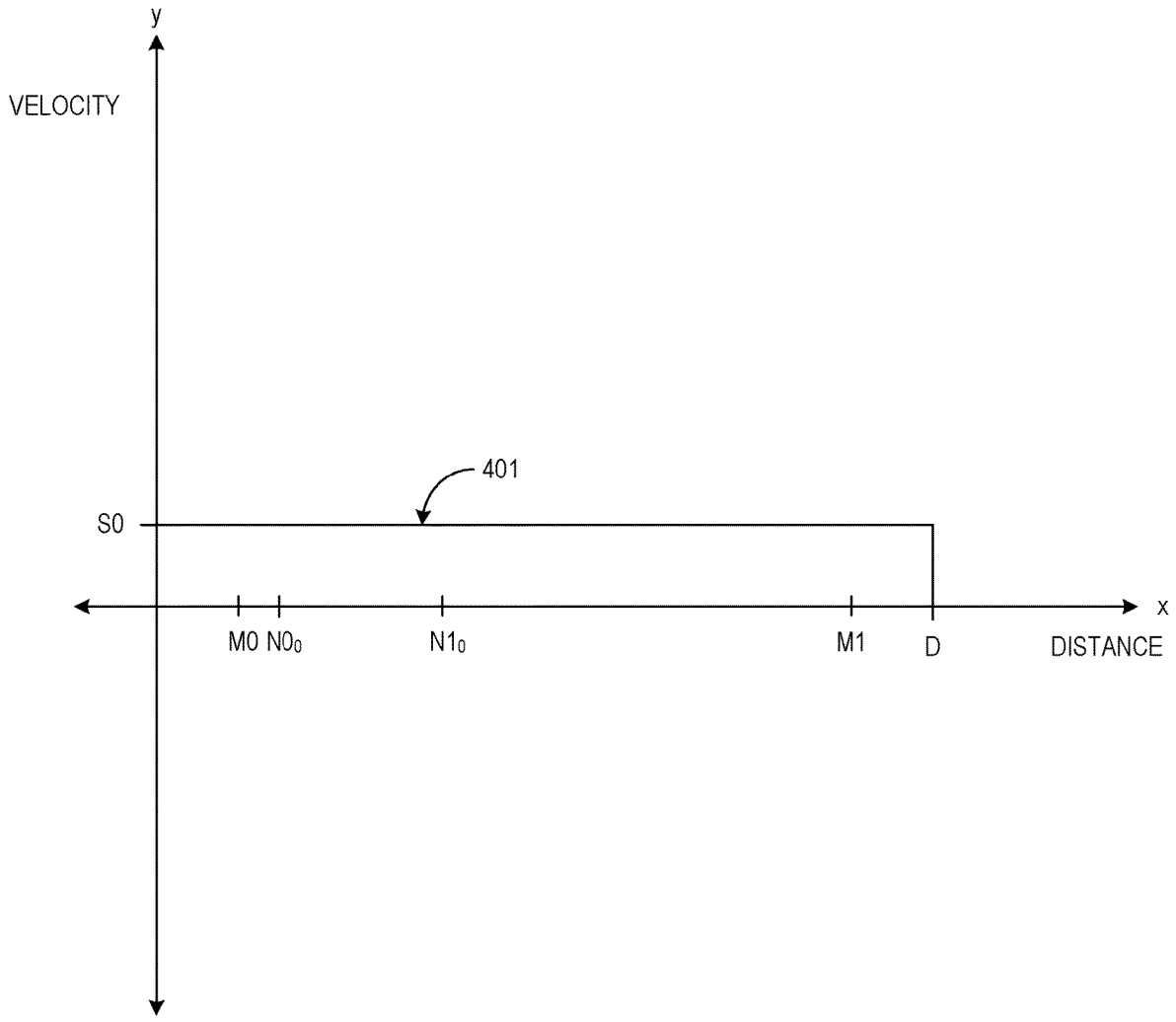
FIG. 4 (PRIOR ART)
FIG. 4 illustrate generally a velocity profile 401 of a conventional method for curing ink using a cure light of an ink jet printer.

FIG. 4 illustrate generally a velocity profile 401 of a conventional method for curing ink using a cure light of an ink jet printer. The plot assumes the cure light can pass over the print media, or card, in the +x direction and the −x direction. The y-axis shows the instantaneous velocity of the cure light at the corresponding x-axis position. The position of the ends of the print media in the direction of movement of the cure light across the printed media are illustrated at x=M0 and x=M1. The extents of one or more printed images on the print media is indicated as $N0_i$ and $x=N1_i$, where i indicates the specific image. The initial position of the cure light prior to curing is assumed to be at x=0. For a conventional single pass cure, the cure light passes over the entire print media in the x direction at a cure speed (S0).

The move is repeated for each new printed media regardless of the location and extent of the printed image on the print media. It is understood that with each change in velocity, there may also be an associated acceleration or deceleration that is not shown in the plot for FIG. 4 or the other velocity profile plots that follow. As discussed above, the initial position of a cure pass is assumed to be at x=0 and the final position is at x=D. It is understood that some cure passes can have the cure light start from the opposite end of the print area such as at x=D and finish at x=0.

In some examples, the cure light can initiate a cure pass from a rest or idle position on the opposite side of the print area such as at x=D.

Figure 5A:
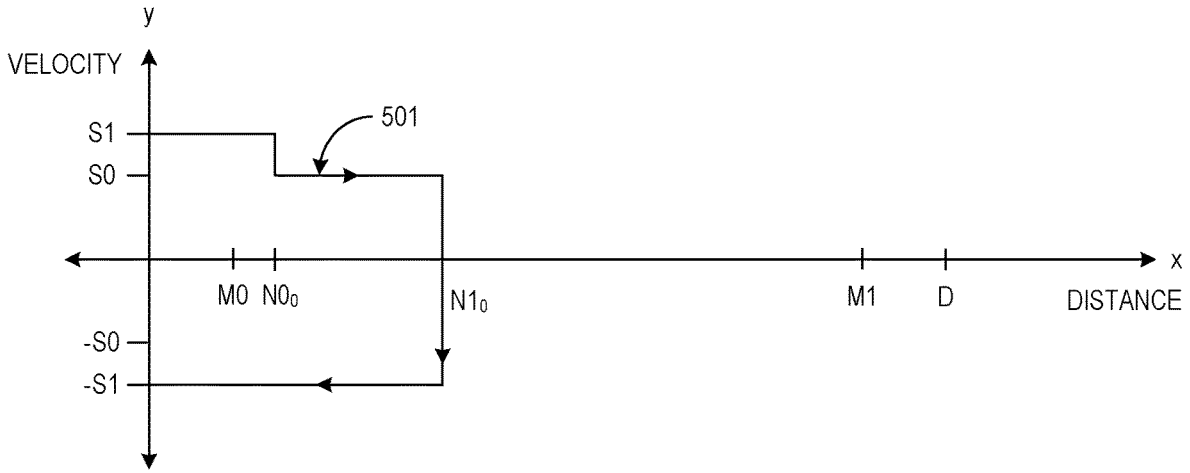
FIGS. 5A and 5B illustrate generally velocity profiles of an improved method for curing ink using a cure light of an ink jet printer, such as the ink jet printer of FIGS. 1-3.
Figure 5B:
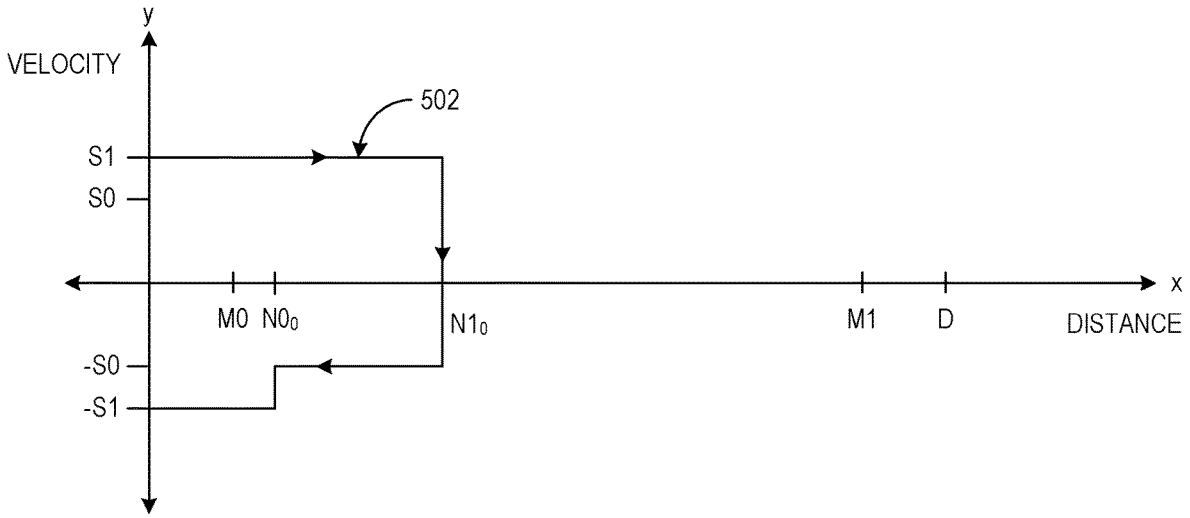

FIGS. 5A and 5B illustrate generally velocity profiles 501, 502 of an improved method for curing ink using a cure light of an ink jet printer, such as the ink jet printer of FIGS. 1-3. In each of FIGS. 5A-5B, the position of the ends of the print media in the direction of movement of the cure light across the printed media are illustrated at x=M0 and x=M1. The extents of one or more printed images on the print media is indicated as $x=N0_i$ and $x=N1_i$, where i indicates the specific image.

The initial position of the cure light prior to curing is assumed to be at x=0. In some examples, the cure light can initiate a cure pass from a rest or idle position on the opposite side of the print area such as at x=D. The plotted line indicates the speed and 2-dimensional direction of the cure light as the cure light cures the curable ink of the printed image. FIG. 5A illustrates the improved path of the cure light, via a velocity profile 501, to cure a print media and image similar to the print media and image illustrated in FIG. 4. An initial move segment of the cure light from the initial position (x=0) to the edge of the image ($x=N0_0$) can be at a relatively high velocity, or index speed, since no portion of the image is below the cure light during the initial move segment. A second move segment can continue to move the cure light over the image in the +x direction but can reduce the velocity of the move segment from the index speed to a cure speed such that the cure light can effectively cure the curable ink of the image. As the cure light reaches the further extent of the image ($x=N1_0$), a third move segment changes the direction of the cure light and moves the cure light back to the initial position (x=0) at the index speed. It is understood that the transitions between each move segment may be different than the illustrated example as additional factors other than relative positions of the cure light and image extents can affect proper curing of the curable ink based on the cure speed. Such factors can include, but are not limited to, the length of the field of projection of the cure light, intensity of the cure light within the field of projection, etc.

FIG. 5B illustrates generally an alternative velocity profile 502 for the example print media and image of FIG. 5A. In the example of FIG. 5B, the method includes an initial move segment of the cure light at an index speed from the initial position (x=0) to the furthest extend of the image ($x=N1_0$) in the X+ direction. The movement of the cure light is then reversed in a second move segment and the velocity reduce to the cure speed as the cure light passes over the image in the x-direction. As the cure light passes the close extent ($x=N0_0$) of the image, a third move segment increases the speed of the cure light and terminates motion of the cure light at the initial position (x=0) to complete the curing of the image of the print media.

The example method can complete the curing process in less time than the conventional method. For example, if the cure speed is $S0_i$, and the distance between the initial position (0) and the final position of the cure light is D, the time (tc) required to complete the cure pass of the cure light for the conventional method is, $$tc=(D)-(0)/S0,=D/S0.$$

If the index speed is S1, the time (te) required to complete the cure pass of improved method is, $$te = (N0_0 - 0)/S1 + (N1_0 - N0_0)/S0 + (N1_0 - 0)/S1$$

$$= N0_0/S1 ++(N1_0 - N0_0)/S0 + (N1_0 - 0)/S1$$

$$te = ((N0_0 - N1_0)/S1 + (N1_0 - N0_0)/S0$$

Assuming that the initial position and final position are at the extents of the printed media, M0=0 and D=M1. Also assume that the extents of the image are $I0_0$=0.2M1 and $I1_0$=0.4M1, and that S1=1.5S0.

$$tc = M1/S0, \text{ and}$$

$$te = (0.2M1 + 0.4M1/S1) + (0.4M1 - 0.2M1)/S0$$

$$= 0.6M1/1.5S0 + 0.2M1/S0$$

$$= (0.6/1.5)M1/S0 + 0.2M1/S0$$

$$= 0.4M1/S0 + 0.2M1/S0$$

$$= 0.6M1/S0$$

As such, the improved method can achieve the cure pass significantly faster than the conventional method (e.g., 0.6M1/S0<<M1/S0). Here, the time savings comes from the faster index speed and the truncated pass of the cure light since the image does not extend halfway across the printed media from the initial location of the cure light. It is understood that the assumed values for the equations above and the equations below are for illustrative purposes and can be any suitable value. In general, the index speed is greater than the cure speed to realize more efficient throughput for curing. It is also understood that in certain examples, instead of truncating the cure pass and retracting to the initial position (x=0), efficiency may still be achieved by allowing the cure light to progress to the opposite side of the print area such as at x=D at the index speed.

Figure 6:
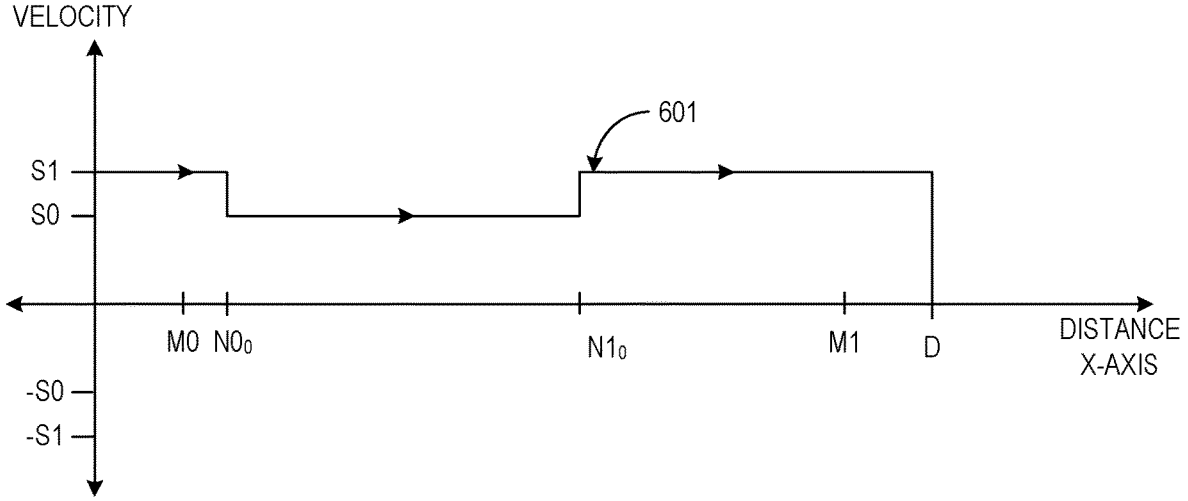
FIG. 6 illustrates an example velocity profile for an improved method for curing ink using a cure light of an ink jet printer where a given image extends at least halfway across the print media.

FIG. 6 illustrates an example velocity profile 601 for an improved method for curing ink using a cure light of an ink jet printer where the one or more images require motion of the cure light to extend at least halfway across the print media. Again, as in FIGS. 5A and 5B, the position of the ends of the print media in the direction of movement of the cure light across the printed media are illustrated at x=M0 and x=M1. The extents of one or more printed images on the print media is indicated as x=$N0_i$ and x=$N1_i$, where i indicates the specific image. The initial position of the cure light prior to curing is assumed to be at x=0. The end of travel of the cure light opposite the initial position (e.g., x=0) is x=D. The plotted line indicates the speed and 2-dimensional direction of the cure light as the cure light cures the curable ink of the printed image.

In the illustrated example of FIG. 6, an initial move segment is executed at the index speed (S1) to move the cure light from the initial position to the near edge (x=$N0_0$) of the image. At the near edge of the image, a second move segment is executed at the cure speed (S0) as the cure light moves from the near edge of the image to the far edge (x=$N0_1$) of the image. At the far edge of the image, a third move segment transitions the speed of the cure light to the index speed to move the cure light from the far edge of the image to the end position of the cure light at or near the end of travel (x=D) to prepare for the next operation of the ink jet printer.

As discussed above, a velocity profile for a conventional cure pass is illustrated in FIG. 4. If the cure speed is S0, and the distance between the initial position (0) and the final position of the cure light is D, the time (tc) required to complete the cure pass of the cure light for the conventional method is, $$tc=(D)-(0)/S0=D/S0.$$

For the example of FIG. 6, the time (te) require to complete the example cure pass is, $$te = (N0_0 - 0)/S1 + (N1_0 - N0_0)/S0 + (D - N1_0)/S1$$

$$= N0_0/S1 + (N1_0 - N0_0)/S0 + (D - N1_0)/S1$$

To simplify the calculations for illustrative purposes, assume the extents of the image are $N0_0$=0.2D and $N1_0$=0.7D, $$te = 0.2D/S1 + (0.7D - 0.2D)/S0 + (D - 0.7D)/S1$$

$$= 0.2D/S1 + 0.5D/S0 + 0.3D/S1$$

$$= 0.5D/S1 + 0.5D/S0$$

If S1=1.5S0, then $$te = 0.5D/1.5S0 + 0.5D/S0$$

$$= 0.33D/S0 + 0.5D/S0$$

$$= 0.83D/S0.$$

As such the improved method allows the cure pass to be completed about 17% faster than the conventional method (e.g., 0.83D/S0<D/S0). In actual applications, the improvement can be even more pronounced because of the additional index distances between the initial position and final position of the cure light and the respective edges of the image that can be completed with a faster velocity (S1) in the improved method compared to the cure velocity (S0) of the conventional method. It is understood that in certain examples, instead of allowing the cure light to progress to the opposite side of the print area such as at x=D at the index speed, efficiency may still be achieved by truncating the cure pass and retracting the cure light to the initial position (x=0) at the index speed.

Figure 7:
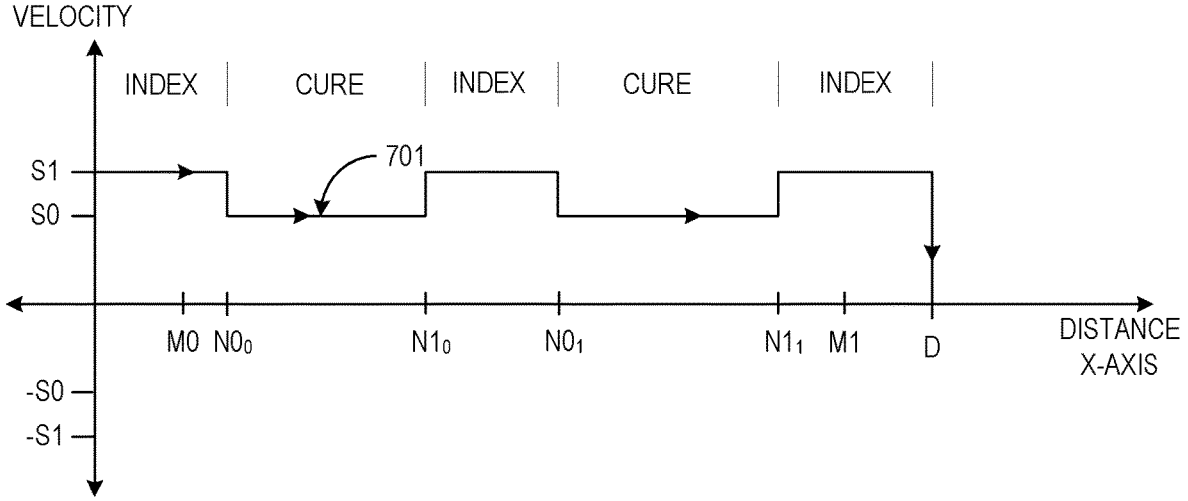
FIG. 7 illustrates generally an example velocity profile of a cure pass over a print media with two images that are separated by a gap.

FIG. 7 illustrates generally an example velocity profile 701 of a cure pass over a print media with two images that are separated by a gap. As in the previous velocity profile drawings, the position of the ends of the print media in the direction of movement of the cure light across the printed media are illustrated at x=M0 and x=M1. The extents of one or more printed images on the print media is indicated as x=$N0_1$ and x=$N1_i$, where "i" indicates the specific image. The initial position of the cure light prior to curing is assumed to be at x=0. The end of travel of the cure light opposite the initial position (e.g., x=0) is x=D. The plotted line indicates the speed and 2-dimensional direction of the cure light as the cure light cures the curable ink of the printed image.

In the illustrated example of FIG. 7, an initial move segment is executed at the index speed (S1) to move the cure light from the initial position (x=0) to the near edge ($x=N0_0$) of the first image. At the near edge of the first image, a second move segment is executed at the cure speed (S0) as the cure light moves from the near edge of the first image to the far edge ($x=N1_0$) of the first image. The ink of the first image is cured during the second move segment. At the far edge of the first image, a third move segment transitions the speed of the cure light to the index speed to move the cure light from the far edge of the first image to the near edge (x=N01) of the second image.

At the near edge ($x=N0_1$) of the second image, a fourth move segment is executed at the cure speed (S0) as the cure light moves from the near edge of the second image to the far edge ($x=N1_i$) of the second image. The ink of the first image is cured during the fourth move segment. At the far edge of the second image, a fifth move segment transitions the speed of the cure light to the index speed (S1) to move the cure light from the far edge of the second image to the end position of the cure light at or near the end of travel (x=D) to prepare for the next operation of the ink jet printer.

The following calculations show the improved performance of the example method as applied to the print media illustrated by the velocity profile of FIG. 7 compared to the conventional cure pass illustrated in FIG. 4. Again, if the cure speed is S0, and the distance between the initial position (0) and the final position of the cure light is D, the time (tc) required to complete the cure pass of the cure light for the conventional method as applied to the print media of FIG. 7 is, $$tc=(D)-(0)/S0=D/S0.$$

For the example of FIG. 6, the time (te) require to complete the example cure pass can include a sum of the execution times ($te_x$) of each move segment, where, $$te_1 = (N0_0 - 0)/S1, \text{ the initial move segment,}$$

$$te_2 = (N1_0 - N0_0)/S0, \text{ the cure pass of the first image,}$$

$$te_3 = (N0_1 - N1_0)/S1, \text{ the index between images,}$$

$$te_4 = (N1_1 - N0_1)/S0, \text{ the cure pass of the first image, and}$$

$$te_5 = (D - N1_1)/S1, \text{ the index to the end of travel.}$$

The entire execution time of the cure pass for the example method is:

$$te=te_1+te_2+te_3+te_4+te_5.$$

For simplicity, assume each of the listed dimensions is referenced to the end of travel like so, $$N0_0 = 0.25D,$$

$$N1_0 = 0.4D,$$

$$N0_1 = 0.55D,$$

$$N1_1 = 0.85D, \text{ and}$$

$$S1 = 1.5S0.$$

Substituting the assumed dimensions gives, $$te1 = (0.25D - 0)/1.5S0 = 0.167D/S0,$$

$$te_2 = (0.4D - 0.25D)/S0 = 0.15D/S0,$$

$$te_3 = (0.55D - 0.4D/1.5S0 = 0.1D/S0$$

$$te_4 = (0.85D - 0.55D/S0 = 0.3D/S0, \text{ and}$$

$$te_5 = (D - 0.85D)/1.5S0 = 0.1D/S0.$$

Summing to find the total execution time gives:

$$\begin{aligned} te &= 0.167D/S0 + 0.15D/S0 + 0.1D/S0 + 0.3D/S0 + 0.1D/S0 \\ &= (0.167 + 0.15 + 0.1 + 0.3 + 0.1)D/S0 \\ &= 0.187D/S0 \end{aligned}$$

Therefore, the improve method for executing a cure pass can complete the pass about 11-12% faster than the conventional method (e.g., 0.187D/S0<D/S0) if the index speed is 1.5 times faster than the cure speed. Over time, this can be a significant improvement in throughput.

Figure 8:
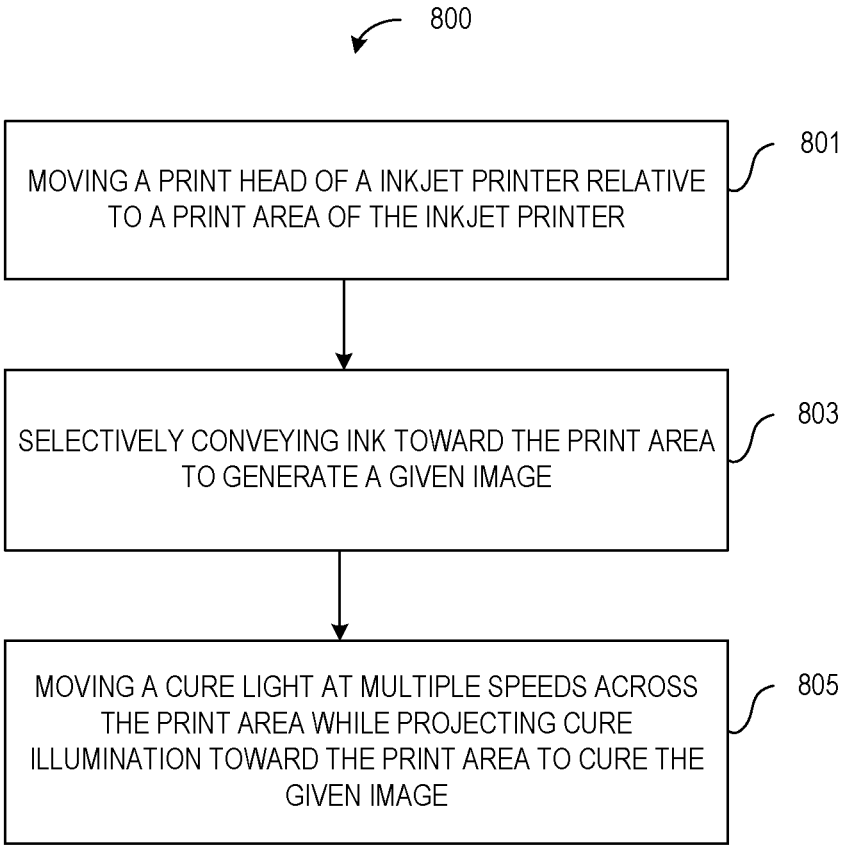
FIG. 8 illustrates generally an example method for operating a ink jet card printer that provides efficient movement of cure illumination over a newly printed image.

FIG. 8 illustrates generally an example method for operating an ink jet card printer that provides efficient movement of cure illumination over a newly printed image. At 801, the print head of the ink jet card printer can be moved relative a print area of the ink jet card printer. At 803, as the printhead is moved across the print area, a controller can provide command signals to dispense light-curable ink from jets of the print head to generate a given image. At 805, an enabled cure light of the ink jet printer can be moved to and across at least a portion of the print area at multiple speeds to expeditiously cure the ink of the given image.

In certain examples, the enabled cure light can be moved at an index speed from an initial position near an edge of the print area to an edge of the given image. As illumination provided by the cure light is projected at a first edge of the given image with an intensity sufficient to begin the curing process, the speed of the enabled cure light can be reduced to a cure speed and the cure light can continue to be moved across the area of the given image. As illumination intensity provided by the cure light fades at the second edge of the given image, the speed of the cure light movement can be adjusted to the index speed. If the second edge of the given image is less than halfway across the print area from the initial position of the cure light, the cure light can be retracted back to the initial position at the index speed. If the second edge of the given image is more than halfway across the print area from the initial position of the cure light, the cure light can be indexed to a second initial position at the opposite end of the print area at the index speed. In some examples, the given image includes gaps between portions of the images. The gaps can be characterized by areas that do not include recently deposited light-curable ink. For such images, the cure light can be indexed at the index speed when traversing the gaps.

By indexing the cure light at a higher speed than the cure speed, or truncating and retracting the cure light at a higher speed than the cure speed, the throughput of the ink jet card printer can be increased compared to conventional methods of moving the cure light at a single cure speed during curing operations across the entire print area.

Figures 9A, 9B, 9C, 9D:
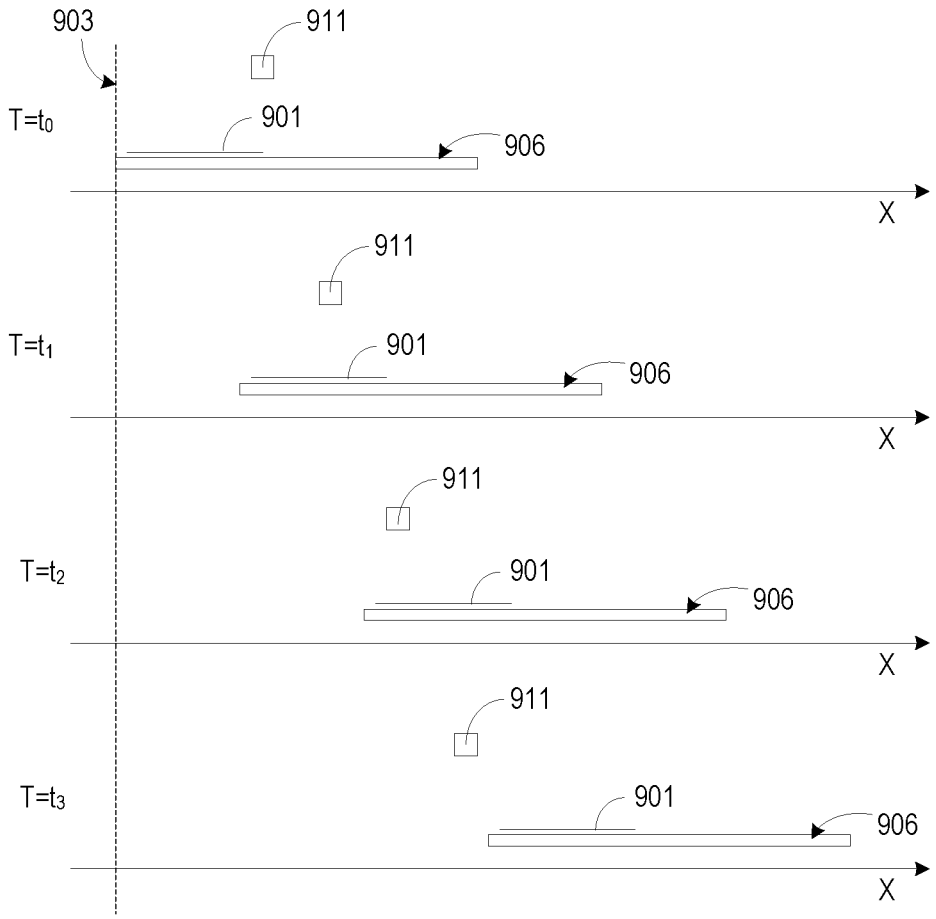
FIGS. 9A-9D illustrate generally an example method for curing an image on a card as the card is removed from the print area of an inkjet card printer.

FIGS. 9A-9D illustrate generally an example method for curing an image on a card 906 as the card 906 is removed from a print area of an inkjet card printer, such as the ink jet card printers o FIGS. 1-3. FIG. 9A illustrates a moment in time ($T=t_0$) after an image is printed on a card 906 within a print area of an inkjet card printer.

Reference line 903 identifies an edge of the card 906 at $T=t_0$ while the card 906 is in the print area of the ink jet card printer. The horizontal axis represents distance (X) in the direction of the indexes discussed below. Reference line 901 identifies generally the extents of the image on the surface of the card in the direction the card is indexed in to and out of the print area of the inkjet card printer. For illustrative purposes for FIGS. 9A-9D, reference line 901 will also be referred to as the image 901. Box 911 represents a general location of a cure light 911 at $T=t_0$. At $T=t_0$, a controller of the ink jet card printer can illuminate the cure light 91 land can begin to index the card 906 out of the print area. In certain examples, the controller may also begin indexing a second card into the print area. In some examples, at $T=t_0$, the controller can also begin to index a second card into a second print area of the ink jet card printer. Also, at $T=t_0$, the controller can begin to index the cure light 911 in the same direction as the card 906.

FIG. 9B illustrates the state of the cure light 911 and the card 906 at $T=t_1$, where $t_1$ is later in time than to. At $T=t_1$, the card 906 has moved about a third of the way out of the print area to the right and the cure light 911 has moved about a third of the way across the image 901 to the left relative to the image 901 while also moving to the right with the card 906. FIG. 9C illustrates the state of the cure light 911 and the card 906 at $T=t_2$, where $t_2$ is later in time than $t_1$. At $T=t_2$, the card 906 has moved about two thirds of the way out of the print area to the right and the cure light 911 has moved about two thirds of the way across the image 901 to the left relative to the image 901 while also moving to the right with the card 906.

FIG. 9D illustrates the state of the cure light 911 and the card 906 at $T=t_3$, where $t_3$ is later in time than $t_2$. At $T=t_3$, the card 906 has moved out of the print area to the right and the cure light 911 has traversed across the image 901 to the left. The difference in velocity of the card 906 with respect to the cure light 911 is the speed of the cure light 911 relative to the image 901. Compared to doing a cure pass with a stationary card, the example method of FIGS. 9A-9D, can increase throughput of the ink jet card printer by executing an exit index of a printed card out of a print area while also curing ink of an image of the card during the exit index. In certain examples, if the image includes two printed areas separated by a non-printed area, after a first area of the image passes under the cure light, the cure light can stop or slow to allow the non-printed area to move at a faster speed (e.g., an index speed) relative to the cure light. After the non-printed area passes under the slowed or stationary cure light, the cure light can increase in speed to move with the exit index of the card to cure the second area of the image at the cure speed.

EXAMPLES AND NOTES

In a first example, Example 1 is a printer comprising: a print head configured to move relative to a print area and to selectively convey light-curable ink toward the print area to generate a first given image; a cure light configured to move relative to the print area and to project cure illumination toward the print area; and a controller configured to move the print head relative to the print area to print a given image, to move the cure light relative to the print area at a cure speed in response to the cure light passing over a printed portion of the first given image to cure the ink of the printed portion of the first given image, and to move the cure light at an index speed in response to the cure light passing over a non-printed portion of the first given image, wherein the index speed is greater than the cure speed.

In Example 2, the subject matter of Example 1 includes, wherein in response to the first given image occupying a portion of the print area biased toward a first edge of the print area, the first given image extending from the first edge of the print area less than half way across the print area toward a second edge of the print area, and the first edge positioned between the position of the cure light and the second edge, the controller is configured to initiate a first move of the cure light at the cure speed in a first direction toward the second edge to cure the first given image, to truncate the first move at a position less than half way between the first edge and the second edge, and retract the cure light toward the first edge at the index speed.

In Example 3, the subject matter of Examples 1-2 includes, wherein in response to the first given image occupying a portion of the print area biased toward a first edge of the print area, the first given image extending from the first edge of the print area more than half way across the print area toward a second edge of the print area, and the first edge positioned between the position of the cure light and the second edge, the controller is configured to initiate a first move of the cure light at the cure speed in a first direction toward the second edge to cure the first given image, and to increase the relative speed of the print head toward the second edge upon the cure light passing over an edge of the given image located closest to the second edge of the print area.

In Example 4, the subject matter of Examples 1-3 includes, wherein the cure light is mechanically coupled with the print head.

In Example 5, the subject matter of Examples 1-4 includes, wherein the print head is an ink jet print head.

In Example 6, the subject matter of Examples 1-5 includes, wherein the print area is stationary, and the print head is movable relative to the print area.

In Example 7, the subject matter of Examples 1-6 includes, wherein the light-curable ink is curable via ultra-violet (UV) light, and the cure light is a UV cure light.

Example 8 is a method comprising: moving a print head of a printer relative to a print area of the printer; selectively conveying ink toward the print area to generate a given image; moving a cure light relative to the print area from an initial position to provide a relative movement between the cure light and the print area; wherein moving the cure light relative to the print area includes: projecting cure illumination toward the print area to cure the given image within the print area; moving the cure light relative to the print area at a cure speed in response to the cure light passing over a printed portion of the given image; moving the cure light relative to the print area at an index speed in response to the cure light passing over a non-printed portion of the given image; and wherein the index speed is greater than the cure speed.

In Example 9, the subject matter of Example 8 includes, moving the cure light relative to the print area at an index speed in response to the cure light passing over a cured portion of the given image.

In Example 10, the subject matter of Example 9 includes, wherein moving the cure light relative to the print area includes planning a complete pass across the print area.

In Example 11, the subject matter of Example 10 includes, truncating the complete pass in response to the given image not extending completely across the print area.

In Example 12, the subject matter of Example 11 includes, wherein truncating the complete pass includes: stopping the relative movement between the cure light and the print area; and retracting the cure light to the initial position.

In Example 13, the subject matter of Examples 8-12 includes, wherein moving the cure light from the initial position includes moving the cure light from the initial position at the index speed.

In Example 14, the subject matter of Example 13 includes, wherein moving the cure light from the initial position includes slowing the cure light from the index speed to the cure speed as a projection of the cure light approaches an uncured edge of the image.

Example 15 is a machine-readable medium including instructions that, when executed by processing circuitry, cause the processing circuitry to perform operations, the operations comprising: moving a print head of a printer relative to a print area of the printer; selectively conveying ink toward the print area to generate a given image; moving a cure light relative to the print area from an initial position to provide a relative movement between the cure light and the print area; wherein moving the cure light relative to the print area includes: projecting cure illumination toward the print area to cure the given image within the print area; moving the cure light relative to the print area at a cure speed in response to the cure light passing over a printed portion of the given image; moving the cure light relative to the print area at an index speed in response to the cure light passing over a non-printed portion of the given image; and wherein the index speed is greater than the cure speed.

In Example 16, the subject matter of Example 15 includes, wherein the operations include including moving the cure light relative to the print area at an index speed in response to the cure light passing over a cured portion of the given image.

In Example 17, the subject matter of Example 16 includes, wherein moving the cure light relative to the print area includes planning a complete pass across the print area.

In Example 18, the subject matter of Example 17 includes, wherein the operations include truncating the complete pass in response to the given image not extending completely across the print area.

In Example 19, the subject matter of Example 18 includes, wherein truncating the complete pass includes operations comprising: stopping the relative movement between the cure light and the print area; and retracting the cure light to the initial position.

In Example 20, the subject matter of Examples 15-19 includes, wherein moving the cure light from the initial position includes operations comprising moving the cure light from the initial position at the index speed.

In Example 21, the cure speed of Example 1-20 is optionally a differential speed between a motion of the cure light and a motion of the print media upon which the image was printed.

In Example 22, the motion of the print media of any one or more of Examples 1-21 optionally is an index to evacuate the print media from the print area.

In Example 23, the index speed is optionally a differential speed between the motion of the print media and a stationary cure light.

Example 24 is at least one machine-readable medium including instructions that, when executed by processing circuitry, cause the processing circuitry to perform operations to implement of any of Examples 1-23.

Example 25 is an apparatus comprising means to implement of any of Examples 1-23.

Example 26 is a system to implement of any of Examples 1-23.

Example 27 is a method to implement of any of Examples 1-23.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

What is claimed is:

1. A printer comprising:

a print head configured to selectively convey light-curable ink toward a print media to generate a first given image;

a cure light configured to project cure illumination toward the print media; and a controller configured to move the print head relative to the print media to print the first given image; and in response to the first given image occupying a portion of the print media biased toward a first edge of the print media such that the first given image extends between the first edge of the print media and less than half way across the print media toward a second edge of the print media, the controller is further configured to move the cure light relative to the print media at a cure speed in a first direction toward the second edge to cure the first given image, truncate moving the cure light at a position less than half way between the first edge and the second edge, and retract the cure light toward the first edge at an index speed, wherein the index speed is greater than the cure speed.

2. The printer of claim 1, wherein the cure light is mechanically coupled with the print head.

3. The printer of claim 1, wherein the cure light is configured to move independent of the print head.

4. The printer of claim 1, wherein the print head is an ink jet print head.

5. The printer of claim 1, wherein the light-curable ink is curable via ultraviolet (UV) light and the cure light is a UV cure light.

6. The printer of claim 1, wherein the controller is configured to move the cure light relative the print media at the index speed in response to the cure light passing over at least one of a non-printed portion of the print media or an already cured portion of the first given image.

7. A printer comprising:

a print head configured to selectively convey light-curable ink toward the print media to generate a first given image;

a cure light configured to project cure illumination toward the print media; and a controller configured to:

move the print head relative to the print media to print the first given image;

to move the cure light relative to the print media at a cure speed in response to the cure light passing over a printed portion of the print media to cure ink of the printed portion; and to move the cure light at an index speed with respect to the print media in response to the cure light passing over a non-printed portion of the print media;

wherein the index speed is greater than the cure speed.

8. The printer of claim 7 wherein, in response to the first given image occupying a portion of the print media extending between the first edge of the print media and more than half way across the print media toward a second edge of the print media, the controller is configured to move the cure light relative to the print media at a cure speed in a first direction toward the second edge to cure the first given image and to increase the relative speed of the cure light toward the second edge upon the cure light passing over an edge of the first given image located closest to the second edge of the print media.

9. The printer of claim 7, wherein the cure light is mechanically coupled with the print head.

10. The printer of claim 7, wherein the cure light is configured to move independent of the print head.

11. The printer of claim 7, wherein the print head is an ink jet print head.

12. The printer of claim 7, wherein the light-curable ink is curable via ultraviolet (UV) light and the cure light is a UV cure light.

13. A printer comprising:

a print head configured to selectively convey light-curable ink toward a first print media to print a first given image on the first print media;

a cure light configured to project cure illumination toward the first print media; and a controller configured to:

move the first print media, with the first given image printed thereon, in a first direction at a first speed;

move the cure light in the first direction at a second speed slower than the first speed, such that the cure light is passed over the first given image at a third speed in a second direction, opposite the first direction, relative to the first print media, the third speed being the difference between the first and second speeds.

14. The printer of claim 13, wherein:

the print head is configured to selectively convey light-curable ink toward the first print media to print a second given image on the first print media spaced from the first given image; and the controller is configured to:

at least one of stop moving the cure light or slow a speed of the cure light in the first direction from the second speed after passing over the first given image; and subsequently increase the speed of the cure light in the first direction to a fourth speed, such that the cure light is passed over the second given image at a fifth speed in the second direction relative to the first print media, the fifth speed being the difference between the first and fourth speeds.

15. The printer of claim 14, wherein the fourth speed is the same as the second speed and the fifth speed is the same as the third speed.

16. The printer of claim 13, further comprising a print area in which the print head prints the first given image on the first print media.

17. The printer of claim 16, wherein the controller is configured to move the first print media, with the first given image printed thereon, from the print area in the first direction at the first speed.

18. The printer of claim 17, wherein the controller is configured to move a second print media into the print area as the first print media is moved from the print area.

19. The printer of claim 13, wherein the print head is an ink jet print head.

20. The printer of claim 13, wherein the light-curable ink is curable via ultraviolet (UV) light and the cure light is a UV cure light.

* * * * *